US006991296B2

(12) United States Patent
Back

(10) Patent No.: US 6,991,296 B2
(45) Date of Patent: Jan. 31, 2006

(54) SKATE WHEEL

(76) Inventor: William James Back, 165 Whitehorn Dr., Vandalia, OH (US) 45377

( * ) Notice: Subject to any disclaimer, the term of this patent is extended or adjusted under 35 U.S.C. 154(b) by 0 days.

(21) Appl. No.: 10/669,911

(22) Filed: Sep. 24, 2003

(65) Prior Publication Data

US 2005/0062333 A1 Mar. 24, 2005

(51) Int. Cl.
*B60B 7/06* (2006.01)

(52) U.S. Cl. ..... 301/5.301; 301/64.302; 301/108.1

(58) Field of Classification Search ..... 301/5.301, 301/5.305, 5.306, 5.308, 5.309, 37.101, 64.301, 301/64.302, 64.305, 108.1, 108.4, 5.7
See application file for complete search history.

(56) References Cited

U.S. PATENT DOCUMENTS 1,351,052 A * 8/1920 Macbeth ..... 301/64.201
1,424,818 A * 8/1922 Guernsey ..... 301/64.302
1,590,284 A * 6/1926 Chapin ..... 301/65
1,602,560 A * 10/1926 Wahlberg ..... 301/6.1
1,672,696 A * 6/1928 Smith ..... 152/396
1,693,067 A * 11/1928 Williams ..... 29/894.361
1,702,386 A * 2/1929 Kranz ..... 29/894.37
1,707,815 A * 4/1929 Robb ..... 152/323
1,989,338 A * 1/1935 Ruske ..... 301/5.307
2,221,553 A * 11/1940 Okun ..... 384/489
2,432,105 A * 12/1947 Wagner ..... 301/5.7
2,722,429 A * 11/1955 Merbler ..... 280/11.28
4,045,046 A * 8/1977 Taylor et al. ..... 280/87.042
4,295,686 A * 10/1981 Black ..... 301/64.302
4,408,803 A 10/1983 Green et al.
4,511,182 A 4/1985 Birnbaum
4,962,968 A 10/1990 Caplin
5,503,466 A * 4/1996 Lew ..... 301/5.307
6,454,361 B1 * 9/2002 Martin ..... 301/5.301

* cited by examiner

*Primary Examiner*—Russell D. Stormer
(74) *Attorney, Agent, or Firm*—Dinsmore & Shohl LLP

(57) ABSTRACT

A skate wheel for skates or skateboards is provided which includes decorative spacers therein. The skate wheel includes a cylindrical outer hub bonded to an outer layer, a cylindrical inner hub, and first and second decorative spacers positioned between the inner surface of the outer hub and the outer surface of the inner hub. The spacers provide an aesthetically pleasing appearance to the wheel as well as provide support for the inner hub within the wheel.

9 Claims, 2 Drawing Sheets

SKATE WHEEL

BACKGROUND OF THE INVENTION

The present invention relates to skate wheels, and more particularly, to a skate wheel for use on roller skates, skateboards, and the like, which includes interchangeable, decorative spacers.

Roller skates and skateboards have been in common use for many years. Skate wheels for use on skates and skateboards are typically rotatably mounted on axles and include bearing assemblies. However, the exposed wheel well area of such a skate wheel is somewhat unsightly due to the appearance of the axle nut and bearings, and detracts from the overall appearance of the roller skate or skateboard.

Many attempts have been made to improve the appearance of skate wheels by, for example, installing a decorative cover over the external wheel well area. See, for example, U.S. Pat. Nos. 4,511,182 and 6,454,361. Such covers may be provided with a number of different designs to improve the appearance of the wheel. However, covers of this sort are purely decorative in nature, and provide no other function or support for the wheel.

Accordingly, there is still a need for an improved decorative cover which improves the appearance of a skate wheel, as well as providing support to the wheel.

SUMMARY OF THE INVENTION

The present invention meets that need by providing a skate wheel, including interchangeable decorative spacers, which not only improve the appearance of the skate wheel, but which function to support the inner hub into which the roller bearings are pressed.

According to one aspect of the present invention, a skate wheel is provided comprising an outer polymeric layer, a cylindrical outer hub having an inner surface and an outer surface, where the outer surface is bonded to the outer polymeric layer, and a a cylindrical inner hub having an inner surface and an outer surface. The inner and outer hubs are preferably comprised of aluminum.

The skate wheel further includes first and second decorative spacers positioned between the inner surface of the outer hub and the outer surface of the inner hub, the spacers each including inner and outer edge surfaces and supporting the inner hub within the wheel.

The decorative spacers are preferably removable and interchangeable. The decorative spacers are each generally disk-shaped and define a flat front surface which preferably includes an inner surface and an outer surface. The spacers preferably include a decorative design or pattern thereon, which is preferably defined by cut out portions of the spacers. The decorative spacers are preferably comprised of a material selected from the group consisting of titanium, aluminum, and plastic. The outer surface of the decorative spacers may also be provided with a decorative colored finish.

In a preferred embodiment of the invention, the inner surface of the outer hub includes a groove into which the outer edge surface of the first decorative spacer is positioned. The inner surface of the outer hub also preferably includes a recessed area into which the outer edge surface of the second decorative spacer is positioned.

Preferably, the outer surface of the inner hub includes two recessed areas into which the inner edge surfaces of the first and second decorative spacers are positioned. The inner surface of the inner hub preferably further includes recessed areas for receiving pressed roller bearings therein.

In another embodiment of the invention, a skate wheel is provided comprising an outer layer; a cylindrical outer hub including inner and outer surfaces which is bonded to the outer layer; a cylindrical inner hub including inner and outer surfaces and first and second outer edges, where the first and second outer edges each include a recessed area therein; and first and second decorative spacers each including inner and outer edge surfaces; wherein the inner edge surface of the first decorative spacer is positioned in the recessed area of the first outer edge of the inner hub, and the inner edge surface of the second decorative spacer is positioned in the recessed area of the second outer edge of the inner hub, the decorative spacers supporting the inner hub within the wheel.

Preferably, the inner surface of the outer hub includes a groove into which the outer edge surface of the first decorative spacer is positioned, and a recessed area into which the outer edge surface of the second decorative spacer is positioned.

Accordingly, it is a feature of the present invention to provide a skate wheel including decorative spacers which support the inner hub of the skate wheel. Other features and advantages of the invention will be apparent from the following description, the accompanying drawings, and the appended claims.

DETAILED DESCRIPTION OF THE PREFERRED EMBODIMENTS

The skate wheel of the present invention offers a number of advantages in that it includes decorative spacers which, in addition to providing a pleasing appearance to the skate wheel, also function to support the inner hub of the skate wheel, which in turn supports the bearing assembly. The decorative spacers may be provided with a number of different patterns or designs, and may be easily interchanged.

Figure 1:
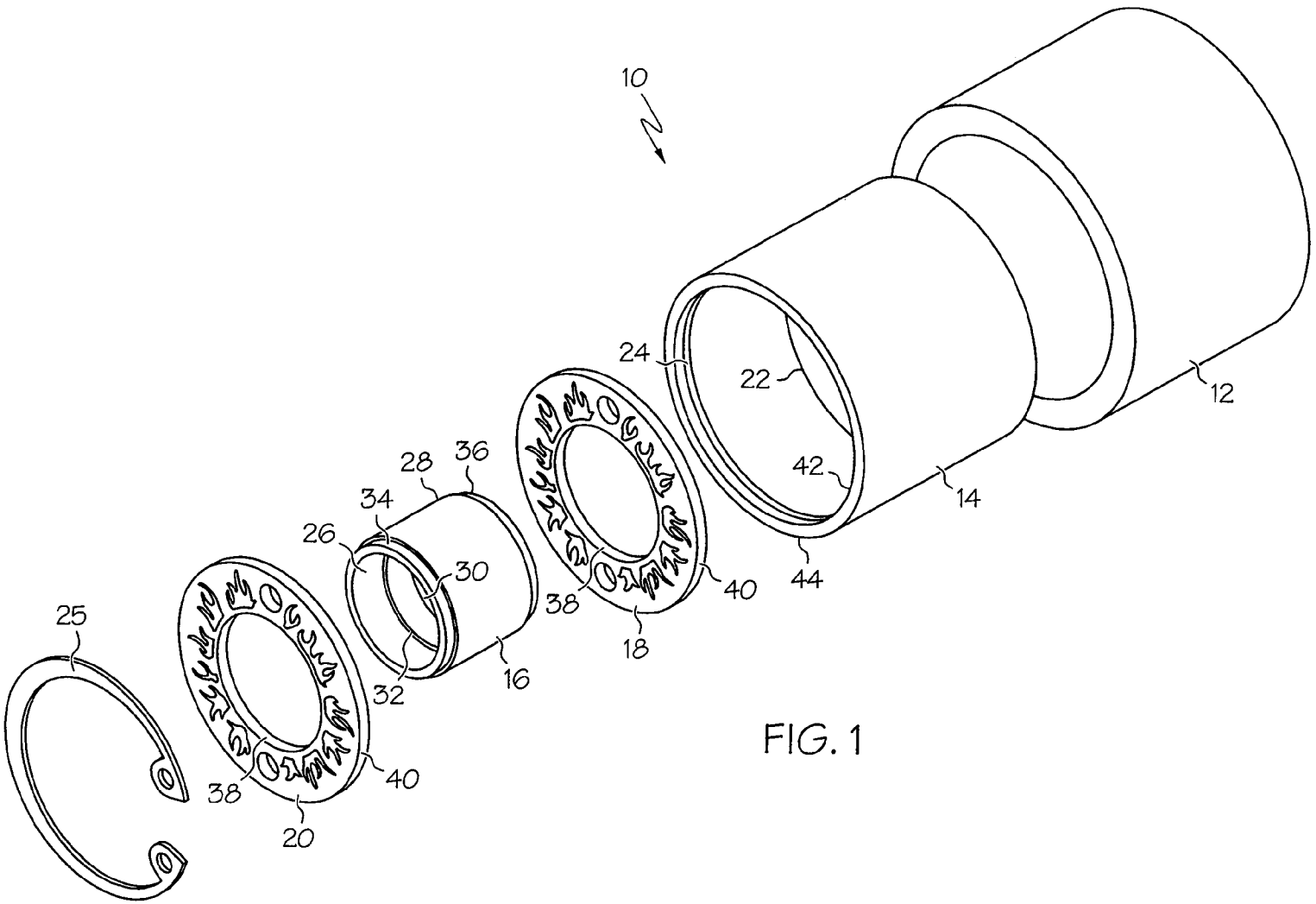
FIG. 1 is an exploded view of a skate wheel according to one embodiment of the present invention.

FIG. 1 illustrates an exploded view of the skate wheel of the present invention. The skate wheel 10 generally includes an outer layer 12, a cylindrical outer hub 14, a cylindrical inner hub 16, and first and second decorative spacers 18 and 20.

The cylindrical outer hub 14 includes an inner surface 42 and outer surface 44. As shown, the outer surface 44 of hub 14 is adhered to outer layer 12. Preferably, outer layer 12 comprises a polymeric layer, such as polyurethane. However, it should be appreciated that any suitable polymer or synthetic rubber may be used. The inner surface 42 of the outer hub 14 further includes a recessed area or shoulder 22 and a groove 24, which allow the decorative spacers 18, 20 to be snap-fitted therein and held in place by a snap ring 25.

The cylindrical inner hub 16 includes an inner surface 26 and outer surface 28. As can best be seen in FIG. 2, the inner surface 26 of inner hub 16 includes recessed areas or pockets 30, 32 into which bearings are fitted. The bearings are typically held in place by an inference fit. In addition, the outer surface 28 of inner hub 16 includes annular recessed areas 34, 36 into which the first and second decorative spacers are positioned.

The inner and outer hubs are preferably comprised of aluminum, but it will be appreciated that they may be formed of any other material which provides suitable support to the wheel.

The first and second decorative spacers 18 and 20 each include inner and outer edge surfaces 38 and 40, respectively. The decorative spacers are removable and may be easily interchanged by snapping them out of the recessed areas into which they are fitted, as will be explained below. As shown, the decorative spacers are each generally disk-shaped and have a flat front surface. The spacers preferably include a decorative design or pattern thereon. The design or pattern is preferably cut out of a portion of the spacers by any of a number of conventional methods, including metal stamping or laser water jets. The decorative spacers are preferably comprised of a material selected from the group consisting of titanium, aluminum, and plastic. The outer surface of the decorative spacers may also be provided with a decorative colored finish to enhance their appearance. Such a colored finish may be provided by painting, coating, or any other finishing technique.

Figure 2:
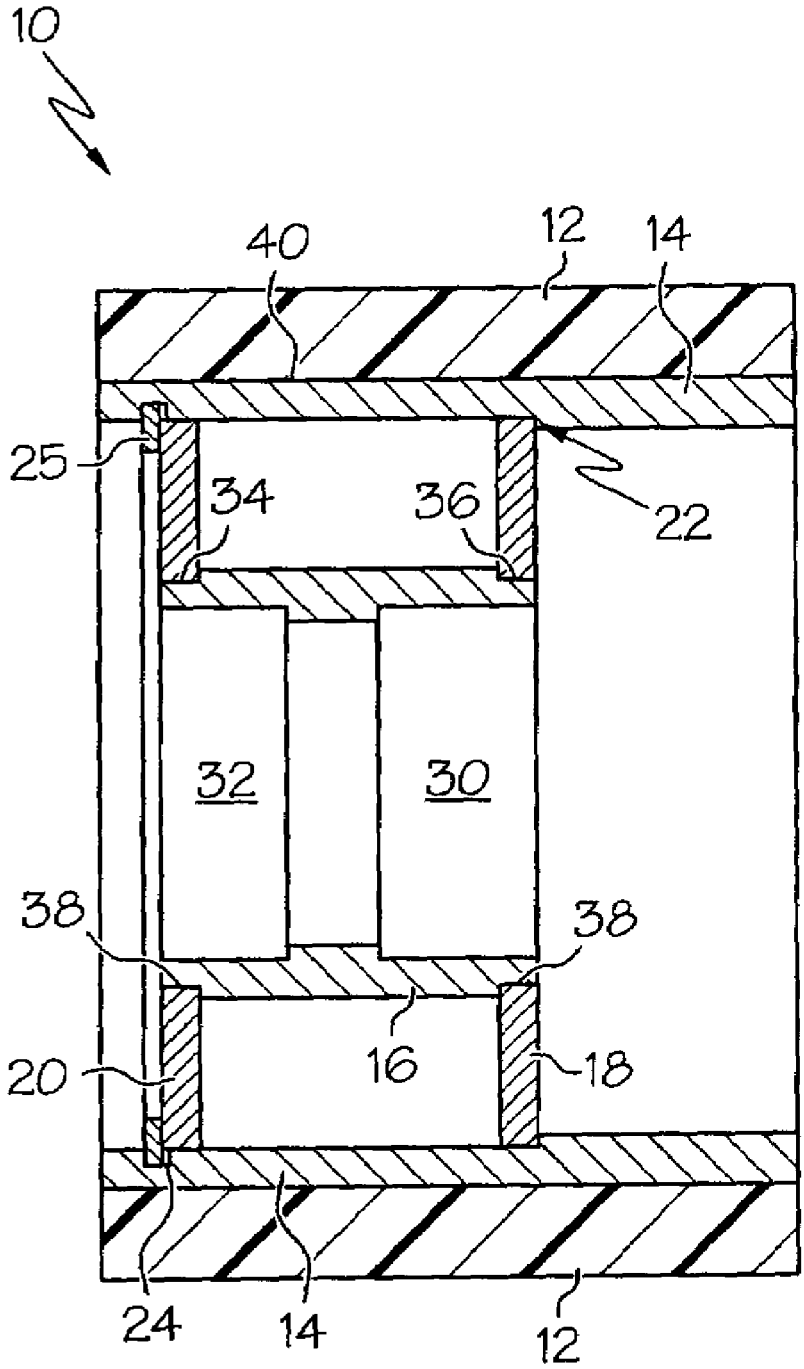
FIG. 2 is a cross-sectional view of the skate wheel of the present invention.

FIG. 2 illustrates a cross-sectional view of the wheel with the decorative spacers assembled therein. In assembling the skate wheel, the outer layer 12 is secured to the outer surface of the outer hub 14. The first decorative spacer 18 is positioned within the inner surface of the outer hub and snap-fitted into the shoulder 22 of the hub. Where the decorative spacer includes a colored outer surface, the spacer should be inserted such that the colored surface faces outward from the wheel. After the first decorative spacer is snap-fitted into place, the inner hub 16 is inserted into the wheel such that the recessed area 36 of inner hub 16 engages the inner surface 38 of the first decorative spacer 18. The bearing assembly may be slip-fitted into the inner hub prior to insertion of the inner hub into the wheel.

Finally, the second decorative spacer 20 is positioned within the wheel such that the inner edge surface 38 engages the recessed area 34 of the inner hub and the outer edge 40 engages the groove portion 24 of the outer hub. The snap-ring 25 is then snapped into place to hold the second spacer 20 in place.

When it is desirable to remove or replace one or both of the decorative spacers, this can be done by snapping or popping the snap-ring and spacers out of their respective positions within the outer and inner hub.

Having described the invention in detail and by reference to preferred embodiments thereof, it will be apparent that modifications and variations are possible without departing from the scope of the invention defined in the appended claims.

What is claimed is:

1. A skate wheel comprising:

an outer polymeric layer;

a cylindrical outer hub having an inner surface and an outer surface, said outer surface bonded to said outer polymeric layer;

a cylindrical inner hub having an inner surface and an outer surface, and first and second decorative spacers positioned between said inner surface of said outer hub and said outer surface of said inner hub, said spacers each including inner and outer edge surfaces; wherein said inner surface of said outer hub includes a groove into which the outer edge surface of said first decorative spacer is positioned, and a recessed area into which the outer edge surface of said second decorative spacer is positioned; wherein said spacers are defined by flat front surfaces and are removable and interchangeable by snapping said spacers out of their respective positions.

2. The skate wheel of claim 1 wherein said spacers include a decorative design or pattern thereon.

3. The skate wheel of claim 2 wherein said design or pattern is defined by cut out portions of said spacers.

4. The skate wheel of claim 1 wherein said inner surface of said inner hub includes recessed areas for receiving pressed roller bearings therein.

5. The skate wheel of claim 1 wherein said outer hub comprises aluminum.

6. The skate wheel of claim 1 wherein said inner hub comprises aluminum.

7. The skate wheel of claim 1 wherein said decorative spacers are comprised of a material selected from the group consisting of titanium, aluminum, and plastic.

8. The skate wheel of claim 1 wherein said decorative spacers have an inner surface and an outer surface.

9. The skate wheel of claim 8 wherein said outer surface of said decorative spacers have a decorative colored finish.

* * * * *